United States Patent [19]

Müller

[11] Patent Number: 4,897,056

[45] Date of Patent: Jan. 30, 1990

[54] PROPELLER FOR WATER VEHICLE

[76] Inventor: Peter Müller, Widmerstrasse 27, Zurich, Switzerland

[21] Appl. No.: 212,662

[22] Filed: Jun. 28, 1988

[30] Foreign Application Priority Data

Jul. 3, 1987 [EP] European Pat. Off. ..... 87109600.4

[51] Int. Cl.[4] ..... B63H 3/02

[52] U.S. Cl. ..... 440/50; 416/147

[58] Field of Search ..... 440/50; 416/147, 153, 416/155, 164–168 R

[56] References Cited

U.S. PATENT DOCUMENTS 2,574,951 11/1951 Benson ..... 416/147

2,953,208 9/1960 O'Connor ..... 416/147

4,599,043 7/1986 Muller ..... 416/167 X

*Primary Examiner*—Sherman D. Basinger

*Attorney, Agent, or Firm*—Helfgott & Karas

[57] ABSTRACT

A variable pitch propeller is fixed to a guide body pivotable about an axis and can be raised above the water surface by its pivoting about the axis. An adjusting device jointly rotating with the hub of variable pitch propeller and positioned on that hub can be set or adjusted without difficulty by a rotatable handle to adjust the pitch of the propeller blades in accordance with the intended travel mode, whereby a detectable fuel saving can be achieved.

10 Claims, 2 Drawing Sheets

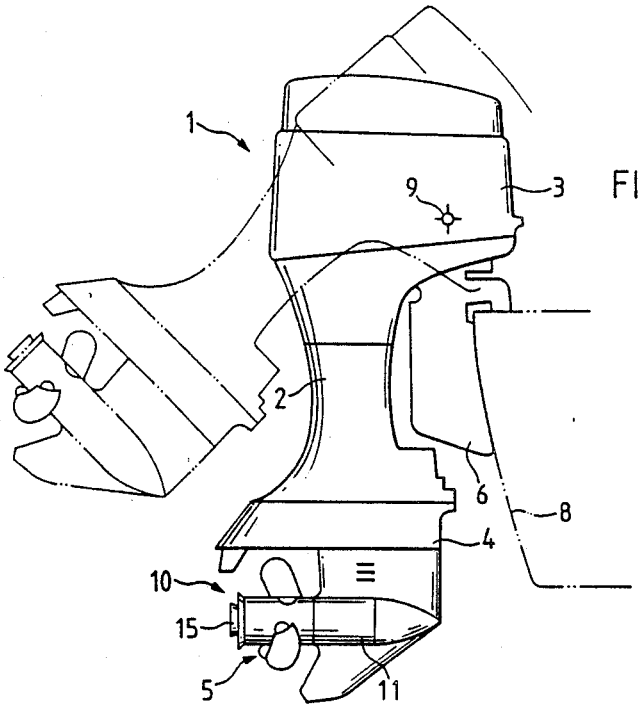
FIG. 1
FIG. 2
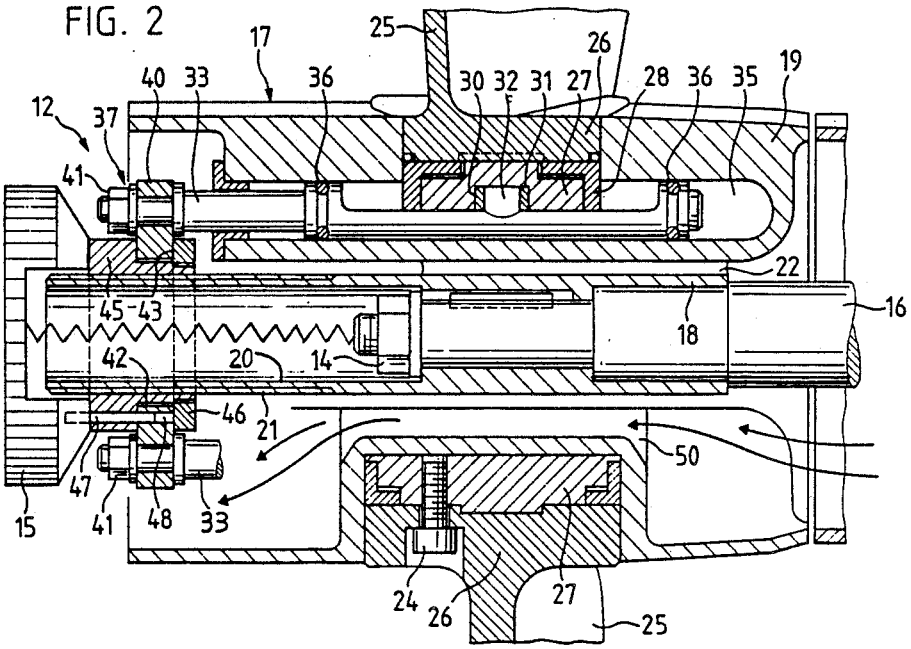

PROPELLER FOR WATER VEHICLE

BACKGROUND OF THE INVENTION

The invention relates to a variable pitch propeller for watercraft, which is mounted in rotary manner in an outboard-supported, pivotable support body and is driven by an engine via a drive connection, its propeller blades being mounted in rotary manner in a propeller hub fixed to the end of the drive connection of a drive shaft and can be set by an adjusting means with different pitch angles.

Variable pitch propellers have long been known as drive means for watercraft. They substantially comprise propeller blades rotatably mounted in a propeller hub and on which the propeller blade pitch can be set. Normally for small drive powers there are two propeller blades and for higher drive powers three, four or more propeller blades. The different constructions of the variable pitch propellers, apart from the number of propeller blades, consequently only differ through the nature of the adjusting means for the propeller blade pitch setting.

The adjusting means for the variable pitch propellers in the case of higher drive or input powers comprise hydrostatic thrust piston drives, which are housed in the interior of drive shaft and the propeller hub. In the case of smaller drive powers mechanical adjusting means are used, in which the propeller blades are adjusted by thrust rods, which act eccentrically on the root or foot of the propeller blade. The actual thrust rods are moved backwards and forwards in the direction of the propeller hub axis via a mechanical linkage. The adjusting force can be applied either manually or by a linear motor.

These adjusting means have proved satisfactory in numerous use cases. However, they suffer from the disadvantage of being complicated to constructions, which are correspondingly expensive. As a result the variable pitch propeller has only been adopted in specific categories of watercraft, because even in the case of the simplest construction the price for certain watercraft categories is still too high.

SUMMARY OF THE INVENTION

The problem of the present invention is to so further develop a variable pitch propeller of the aforementioned type, that this obstacle is overcome and the adjusting means is further simplified, so that the variable pitch propeller with its indisputable advantages compared with the fixed propellers can also be used in other watercraft categories, where it has hitherto been unusable for the aforementioned reasons.

According to the invention this problem is solved in that the adjusting means is constructed as a mechanism rotating with the propeller hub and is integrated into the latter, the adjusting means having a manually operable, handle positioned on the outflow side and which is spaced from an adjusting linkage and with which the adjusting linkage acting on the root of the propeller blade can be set in accordance with the desired pitch of the propeller blades.

Thus, the constructional effort or the adjusting means can be significantly reduced. However, this solution presupposes that the propeller hub is accessible in a simple manner. However, this is the case in the known outboard motor drives and in the so-called Z-drives, which are used in large numbers. The variable pitch propeller is rotatably mounted on an outboard-supported, pivotable support body and is driven by an engine which, as for the outboard motor drive, is fixed to the support body or, as for the Z-drive, is housed in the hull of the watercraft. The transmission of the power of the engine, normally a thermal engine, to the variable pitch propeller takes place by means of toothed gearings and shafts, the shaft arranged at the end of the transmission mechanism carrying the variable pitch propeller. Both in the case of outboard motor and Z-drives the support body can be pivoted to such an extent with the variable pitch propeller mounted thereon that the propeller wholly or at least partly is located above the water surface, so that it is easily accessible and can be set or adjusted without difficulty.

BRIEF DESCRIPTION OF THE DRAWING

The invention is described in greater detail hereinafter relative to a non-limitative embodiment and the attached drawings, wherein show:

FIG. 1 a side view of an outboard drive with a variable pitch propeller provided with the inventive adjusting means.

FIG. 2 a diagrammatically represented longitudinal section of the hub of the variable pitch propeller for the outboard drive according to FIG. 1.

DETAILED DESCRIPTION OF THE PREFERRED EMBODIMENTS

Figure 3:
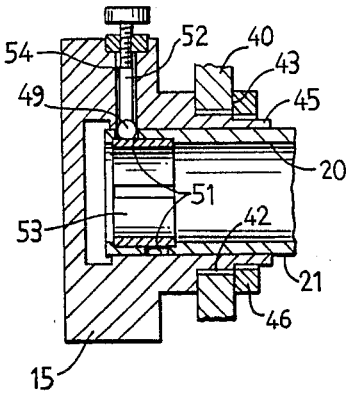
FIG. 3 a variant of the adjusting means according to FIG. 2.

The invention is based on the idea that for simplifying the adjusting drive, use must be made of the already existing pivotability of the outboard motor drive. Through pivoting the drive the variable pitch propeller connected to said drives is pivoted above the water level and is consequently readily accessible.

The outboard motor drive 1 shown in FIG. 1 has a support body 2, on which is supported an engine, preferably a thermal engine, covered by a hood 3.

At the lower end 4 of support body 2 is located a variable pitch propeller 5, which is fixed to a not shown drive shaft. The horizontal drive shaft is driven by the engine via a shaft mounted in the support body 2 and via a mitre gear. Such a mechanical power transmission from the engine to the variable pitch propeller 5 is generally known and will consequently not be described in detail.

The outboard drive 1 is rotatably mounted on a fixing support 6, which is fixed at the point provided for the same on the rear wall 8 of the hull partly shown in broken line form.

Support body 2 is pivotably mounted about an axis 9 and can be pivoted in the position shown in broken line form, so that the variable pitch propeller 5 projects out of the water. On the outflow side 10 of the variable pitch propeller an adjusting means 12 is fixed to its hub 11, cf. FIG. 2, which has a handle 15 projecting out of the hub 11. The adjusting means 12 will be described in greater detail with reference to FIG. 2.

A propeller hub 17 is fixed to the drive shaft 16 connected to the drive of the engine by a drive connection. The propeller hub 17 comprises an inner hub 18 and an outer hub 19. The inner hub 18 is substantially an annular hollow body, which is mounted on the end of drive shaft 16 and locked with a nut 14. The inner hub 18 has a tubular hub extension 20 provided at its end with an external thread 21.

The outer hub 19 is also a substantially closed ring, which is connected by webs 22 to the inner hub 18. Between the webs 22 are located passages or channels 50, through which flue gases of the engine are carried off. Propeller blades 25 are rotatably mounted in outer hub 19. Each propeller blade has a root 26 and is screwed by means of screws 24 to an adjusting plate 27, which is rotatably guided by a retaining ring 28 screwed into the outer hub 19.

In the adjusting plate 27 is formed a guide groove 30, in which is guided a pivot pin 32 having a slide ring 31.

Pivot pin 32 is part of a push rod 33, which is located in a bore 35 in the outer hub 19. The annular outer hub 19 has a corresponding material thickening at the mounting point of the propeller blade 25.

The push rods 33, which are provided with seals 36, e.g. O-rings for sealing the bore 35 and the space around the adjusting plate 27, are interconnected at the end 37 projecting out of bore 35 by a synchronous flange 40, which is fixed by nuts 41 to the ends 37 of push rods 33.

The synchronous flange 40 has an internal bore 42 with which said flange 40 is rotatably guided in a guide groove 43 of a spindle nut 45. In order that the synchronous flange 40 can be inserted in guide groove 43, the spindle nut has a screw ring 46, with which one side wall of the guide groove 43 is formed.

Together with the hub extension 20 carrying the external thread 21, the spindle nut 45 forms a worm gear, which is rotatable by handle 15. For this purpose handle 15 is equipped with axially directed pins 47, which project through the spindle nut 45 into bores 48 of synchronous flange 40.

The handle 15 is drawn by not shown spring tension against spindle nut 45. If the spindle nut is to be axially displaced for adjusting the pitch of the propeller blades 25, then the handle 15 is retracted to such an extent that the pins 47 are pulled from flange 40 to allow the spindle nut 45 to be rotated by handle 15. As a result of the rotation of spindle nut 45, the latter and therefore also the synchronous flange 40 with the push rod 33 are axially displaced, the displacement of the push rod 33 bringing about a rotation of adjusting plate 27 and consequently of propeller blade 25. Once the desired pitch of the propeller blade 25 has been set, the pins 47 of handle 15 are again locked in bores 48 synchronous flange 40.

Thus, the worm gear is fixed, so that any undesired adjustment of the pitch of the propeller blade 25 is prevented.

FIG. 3 shows a another embodiment of the adjusting means at the handle 15. The locking of the handle 15, which can be constructed as one piece with the spindle nut 45, takes place by means of a locking ball 49, which is located in a passage 51 of the hub extension 20 and several of the balls are distributed in axially displaced manner on the circumference of the hub extension 20. By loosening a support pin 52 located in a radial bore 54 of handle 15, it is possible to rotate the latter, so that synchronous flange 40 is moved and consequently the pitch of propeller blades 25 is adjusted. In place of the support pin 52 it is also possible to use a spring, which can remove the locking ball 49 from passage 51 on rotating handle 15. As the handle 15 is axially displaced with the spindle nut 45, the further passages 51 are to be arranged in axially displaced manner, so that it is possible to fix the handle 15 for any set pitch. An internally introduced leaf spring 53 ensures that the locking ball 49 cannot drop into the hub extension 20.

As result of the described adjusting means, it is possible to adapt the pitch of the variable pitch propeller 25 to the particular travel conditions. Thus, if e.g. the watercraft is used in connection with water skiing, the propeller blades 25 are set to a lower pitch, which leads to a much better propulsive efficiency. For fast travel, a higher pitch of the propeller blades 25 is set by further turning of handle 15, so that once again a good propulsive efficiency is obtained. A detectable fuel saving results from this setting possibility. This saving is achieved by a simple and therefore inexpensive solution, which can also be operated without difficulty. It is important that the worm gear, which can be constructed in self-locking manner, does not require a significantly larger diameter than that of the inner hub 18, so that the carrying off of the engine flue gases taking place through the passage channels 50 is unimpeded.

Figure 4:
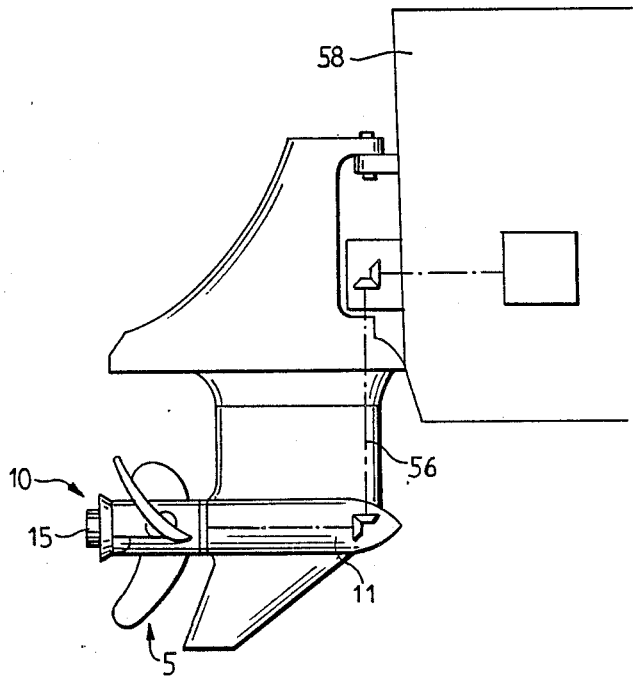
FIG. 4 shows a Z-drive.

FIG. 4 shows a Z-drive 56 connected to the motor of watercraft 58.

I claim:

1. Variable pitch propeller for watercraft, which is rotatably mounted on an outboard-supported, pivotable support body and is driven by an engine via a drive connection, the propeller comprising a drive shaft fixed to said drive connection; a propeller hub fixed to said drive shaft; a plurality of propeller blades rotatably mounted to said propeller hub; and adjusting means for adjusting said blades to different pitch angles, said adjusting means being constructed as a mechanism rotating with said propeller hub and being integrated into said hub, said adjusting means including an adjusting linkage operatively connected to said blades, and a manually operable handle arranged on an outflow side of the propeller and spaced from said adjusting linkage and adapted to set said adjusting linkage acting on roots of said propeller blades in accordance with a desired pitch of the propeller blades, said hub including an inner hub and an outer hub surrounding said inner hub and supporting said blades, said adjusting means further including a worm gear fixed to said inner hub which has a spindle portion, said worm gear including a spindle nut rotatable on said spindle portion and being operatively connected to said adjusting linkage by a synchronous flange to displace the same for adjusting said blades, said handle being coupled with said spindle nut in a non-rotary manner to be axially displaceable in respect thereto, and at least one removable locking pin axially extending in said spindle nut and said flange for preventing rotation of said spindle nut after said baldes have been adjusted, said pin being removed from said flange for permitting rotation of said handle.

2. The propeller according to claim 1, wherein at least one passage is provided in said propeller hub to pass flue gases therethrough.

3. The propeller according to claim 1, wherein said adjusting means are constructed so that following each pitch setting of said blades, said adjusting means are fixed in position by said handle.

4. The propeller according to claim 1, wherein said handle is biased relative to said spindle nut.

5. The propeller according to claim 1, wherein said adjusting linkage includes an adjusting plate provided at and connected to the roots of said blades, a plurality of push rods interconnected said synchronous flange, and pivot pins carried by said adjusting plate and cooperating with said push rods.

6. Variable pitch propeller for watercraft, which is rotatably mounted on an outboard-supported, pivotable support body and is driven by an engine via a drive connection, the propeller comprising a drive shaft fixed to said drive connection; a propeller hub fixed to said drive shaft; a plurality of propeller blades rotatably mounted in said propeller hub; and adjusting means for adjusting said blades to different pitch angles, said adjusting means being constructed as a mechanism rotating with said propeller hub and being integrated into said hub, said adjusting means including a manually operable handle arranged on an outflow side of the propeller and spaced from said adjusting linkage and adapted to set said adjusting linkage acting on roots of said propeller blades in accordance with a desired pitch of the propeller blades, said hub including an inner hub and an outer hub surrounding said inner hub and supporting said blades, said adjusting means further including a worm gear fixed to said inner hub which has a spindle portion, said worm gear including a spindle nut rotatable on said spindle portion and being operatively connected to said adjusting linkage by a synchronous flange to displace the same for adjusting said blades, said handle being rigidly fixed to said spindle nut to rotate therewith, said spindle portion having a passage, and at least one removable locking ball located partially in said passage and partially in a bore formed in said handle to lock said handle, said ball being removed from said passage to permit rotation of said handle.

7. The propeller according to claim 1, wherein said adjusting means are used with outboard motor drives.

8. The propeller according to claim 6, wherein said adjusting means are used with outboard motor drives.

9. The propeller according to claim 1, wherein said adjusting means are used with Z-drives.

10. The propeller according to claim 6, wherein said adjusting means are used with Z-drives.

* * * * *